US012716318B2

(12) United States Patent
Lee et al.

(10) Patent No.: US 12,716,318 B2
(45) **Date of Patent: *Aug. 25, 2026**

(54) MANDREL ASSEMBLIES FOR A PLUG AND ASSOCIATED METHODS

(71) Applicant: G&H Diversified Manufacturing LP, Houston, TX (US)

(72) Inventors: Timmothy Alain Lee, Tomball, TX (US); Joshua Magill, Waco, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/949,471

(22) Filed: Nov. 15, 2024

(65) Prior Publication Data

US 2025/0067143 A1 Feb. 27, 2025

Related U.S. Application Data

(63) Continuation of application No. 17/610,008, filed as application No. PCT/US2020/032221 on May 8, 2020, now Pat. No. 12,146,380.

(60) Provisional application No. 62/846,366, filed on May 10, 2019.

(51) Int. Cl.

| | |
|---|---|
| ***E21B 33/129*** | (2006.01) |
| ***E21B 23/06*** | (2006.01) |
| ***E21B 33/12*** | (2006.01) |

(52) U.S. Cl.

CPC ..... *E21B 33/129* (2013.01); *E21B 23/06* (2013.01); *E21B 33/12* (2013.01)

(58) Field of Classification Search

CPC ..... E21B 23/06; E21B 33/12; E21B 33/129; E21B 33/1204; E21B 33/134

See application file for complete search history.

(56) References Cited

U.S. PATENT DOCUMENTS 7,740,079 B2 * 6/2010 Clayton ..... E21B 33/1294 166/135
8,079,413 B2 * 12/2011 Frazier ..... E21B 23/06 165/135
8,205,671 B1 * 6/2012 Branton ..... E21B 33/134 166/217

(Continued)

FOREIGN PATENT DOCUMENTS

WO WO-2018009487 A1 * 1/2018 ..... E21B 33/134

*Primary Examiner* — Daniel P Stephenson
(74) *Attorney, Agent, or Firm* — Conley Rose, P.C.

(57) ABSTRACT

A bridge plug for sealing a wellbore includes a mandrel assembly including an inner rod that is solid across a central axis thereof to restrict fluid communication across the mandrel assembly in both a first axial direction and an opposed second axial direction, and an outer rod including a different material than the inner rod and that is distinct from the inner rod whereby the outer rod overlies the inner rod, and a packer disposed about the mandrel assembly, the packer configured to seal the wellbore in response to the bridge plug being actuated from a first position to a second position, wherein the mandrel assembly is configured to apply a compressive force to the packer as the bridge plug is actuated from the first position to the second position and to maintain the compressive force until removed by an external tool.

21 Claims, 6 Drawing Sheets

(56) References Cited

U.S. PATENT DOCUMENTS

| | | | | |
|---|---|---|---|---|
| 8,596,347 | B2 * | 12/2013 | Valencia | E21B 33/1204 166/134 |
| 8,839,855 | B1 * | 9/2014 | McClinton | E21B 34/14 166/135 |
| 8,887,818 | B1 * | 11/2014 | Carr | E21B 43/26 166/387 |
| 9,845,658 | B1 * | 12/2017 | Nish | E21B 33/128 |
| 11,396,787 | B2 * | 7/2022 | Kellner | E21B 33/12 |
| 12,146,380 | B2 * | 11/2024 | Lee | E21B 33/12 |
| 2003/0226660 | A1 * | 12/2003 | Winslow | E21B 33/1216 166/134 |
| 2007/0029080 | A1 * | 2/2007 | Moyes | B21D 15/06 166/179 |
| 2008/0060821 | A1 * | 3/2008 | Smith | E21B 33/1216 166/134 |
| 2011/0290473 | A1 * | 12/2011 | Frazier | E21B 33/134 166/135 |
| 2012/0061105 | A1 * | 3/2012 | Neer | E21B 33/1216 166/135 |
| 2012/0125642 | A1 * | 5/2012 | Chenault | E21B 33/1292 166/387 |
| 2014/0045731 | A1 * | 2/2014 | Daccord | C09K 8/03 264/145 |
| 2018/0142096 | A1 * | 5/2018 | Li | E21B 33/124 |
| 2018/0202257 | A1 * | 7/2018 | VanLue | E21B 33/134 |
| 2019/0352999 | A1 * | 11/2019 | Greenlee | B65H 54/04 |
| 2022/0228459 | A1 * | 7/2022 | Lee | E21B 33/12 |
| 2025/0067143 | A1 * | 2/2025 | Lee | E21B 33/129 |

* cited by examiner

MANDREL ASSEMBLIES FOR A PLUG AND ASSOCIATED METHODS

CROSS-REFERENCE TO RELATED APPLICATIONS

This application is a continuation of U.S. non-provisional patent application Ser. No. 17/610,008 filed Nov. 9, 2021, entitled "Mandrel Assemblies for a Plug and Associated Methods", which is a 35 U.S.C. § 371 of international application No. PCT/US2020/032221 filed May 8, 2020, entitled "Mandrel Assemblies for a Plug and Associated Methods" which claims benefit of U.S. provisional patent application Ser. No. 62/846,366 filed May 10, 2019, entitled "Bridge Plug," all of which are hereby incorporated herein by reference in their entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, the downhole plug may comprise a "bridge plug" configured to seal or isolate the portion of the wellbore extending uphole from the bridge plug upon setting of the bridge plug. In other applications, the downhole plug may comprise a "frac plug" that permits fluid flow through a central passage of the frac plug. Once the casing string has been perforated by the perforating gun and the frac plug has been set, a ball or dart may be pumped into the wellbore for landing against the set frac plug, thereby isolating the portion of the wellbore extending uphole from the frac plug. With this uphole portion of the wellbore isolated, the formation extending about the perforated section of the casing string may be hydraulically fractured by fracturing fluid pumped into the wellbore.

SUMMARY OF THE DISCLOSURE

An embodiment of a bridge plug for sealing a wellbore comprises a mandrel assembly comprising an inner rod that is solid across a central axis thereof to restrict fluid communication across the mandrel assembly in both a first axial direction and an opposed second axial direction, and an outer rod comprising a different material than the inner rod and that is distinct from the inner rod whereby the outer rod overlies the inner rod, and a packer disposed about the mandrel assembly, the packer configured to seal the wellbore in response to the bridge plug being actuated from a first position to a second position, wherein the mandrel assembly is configured to apply a compressive force to the packer as the bridge plug is actuated from the first position to the second position and to maintain the compressive force until removed by an external tool. In some embodiments, the inner rod comprises a pultruded rod and the outer rod comprises a filament wound outer rod. In some embodiments, the inner rod comprises a composite material and the outer rod comprises a glass filament material. In certain embodiments, the outer rod of the mandrel assembly comprises an inner surface and an inner surface feature positioned on the inner surface, and the inner rod of the mandrel assembly comprises an outer surface and an outer surface feature positioned on the outer surface that is in interlocking engagement with the inner surface feature of the outer rod. In certain embodiments, the outer surface feature of the inner rod comprises a protrusion received within the inner surface feature of the outer rod. In some embodiments, an end of the outer rod is configured to couple to a setting tool for actuating the bridge plug from the first position to the second position. In some embodiments, the bridge plug comprises a slip assembly configured to affix the plug to a string disposed in the wellbore in response to the bridge plug being actuated from the first position to the second position. In certain embodiments, the outer rod of the mandrel assembly comprises a first helical pattern formed on an inner surface of the outer rod and which comprises a first helical groove and a first helical ridge, and the inner rod of the mandrel assembly comprises a second helical pattern formed on an outer surface of the inner rod and which comprises a second helical groove and a second helical ridge, wherein the second helical ridge is interlockingly received in the first helical groove. In certain embodiments, the inner rod is solid across the entire outer diameter of the inner rod.

An embodiment of a plug for sealing a wellbore comprises a mandrel assembly comprising an outer rod comprising an inner surface and an inner surface feature positioned on the inner surface, and an inner rod that is distinct from the outer rod and comprises a different material than the outer rod, wherein the inner rod comprises an outer surface and an outer surface feature positioned on the outer surface that is in interlocking engagement with the inner surface feature of the outer rod, and a packer disposed about the mandrel assembly, the packer configured to seal the wellbore in response to the plug being actuated from a first position to a second position, wherein the mandrel assembly is configured to apply a compressive force to the packer as the plug is actuated from the first position to the second position. In some embodiments, the outer surface feature of the inner rod comprises a protrusion received within the inner surface feature of the outer rod. In some embodiments, the outer surface feature of the inner rod comprises a first helical pattern and the inner surface feature of the outer rod comprises a second helical pattern. In certain embodiments, the first helical pattern comprises a helical ridge that is interlockingly received in a helical groove of the second helical pattern. In certain embodiments, the outer surface feature of the inner rod is configured to increase a surface roughness of the outer surface of the inner rod. In some embodiments, the inner rod comprises a pultruded rod and the outer rod comprises a filament wound rod. In some embodiments, the inner rod comprises a central passage extending partially through the inner rod. In certain embodiments, the plug comprises a slip assembly configured to affix the plug to a string disposed in the wellbore in response to the plug being actuated from the first position to the second position.

An embodiment of a method for fracturing an earthen subterranean formation comprises (a) deploying a tool string into a wellbore extending through the subterranean formation, the tool string comprising a perforating gun and a bridge plug including a mandrel assembly that comprises an inner rod that is solid across a central axis of the inner rod, and an outer rod that is distinct from the inner rod such that the outer rod overlies the inner rod, and further wherein the outer rod comprises a different material than the inner rod and the inner rod and the outer rod cooperate to restrict fluid communication across the mandrel assembly in both a first axial direction and an opposed second axial direction, (b) actuating the bridge plug from a first position to a second position whereby a packer of the bridge plug disposed about the mandrel assembly seals the wellbore, wherein the mandrel assembly applies a compressive force to the packer as the bridge plug is actuated from the first position to the second position, (c) actuating the perforating gun to form a plurality of perforations in a casing string lining the wellbore thereby establishing fluid communication between the wellbore and the subterranean formation, (d) pumping a fracturing fluid through the wellbore and into the subterranean formation through the plurality of perforations formed in the casing string, and (e) drilling out the mandrel assembly of the bridge plug by an external tool to release the compressive force applied by the mandrel assembly to the packer of the bridge plug. In certain embodiments, (e) establishes fluid communication across the mandrel assembly in at least one of the first axial direction and the second axial direction. In some embodiments, the inner rod is solid across the entire outer diameter of the inner rod.

BRIEF DESCRIPTION OF THE DRAWINGS

For a detailed description of exemplary embodiments of the disclosure, reference will now be made to the accompanying drawings in which.

DETAILED DESCRIPTION

Figure 1:
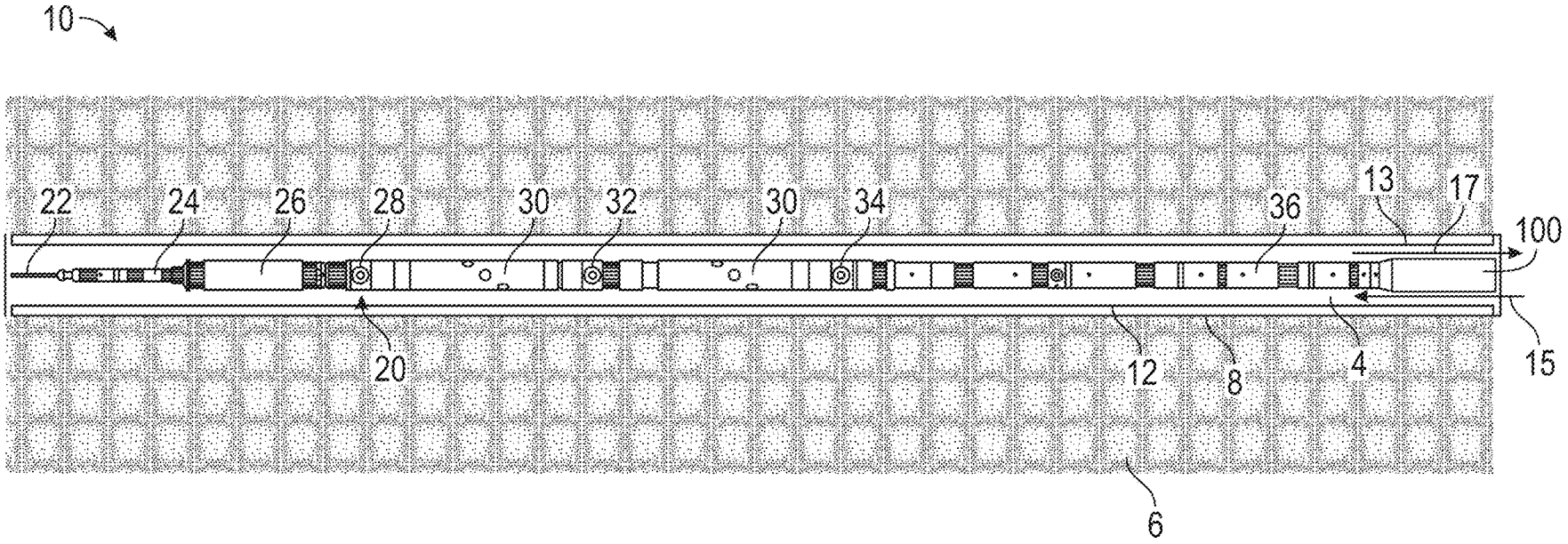
FIG. 1 is a schematic, partial cross-sectional view of a system for completing a subterranean well including an embodiment of a downhole plug in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface or wall 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 such as, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 30, a switch sub 32, a plug-shoot firing head 34, a setting tool 36, and a downhole or bridge plug 100 (shown schematically in FIG. 1). Cable head 24 is the uppermost component of tool string 20 and includes an electrical connector for providing electrical signal and power communication between the wireline 22 and the other components (CCL 26, perforating guns 30, setting tool 36, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 30 and associated tools, such as the setting tool 36 and bridge plug 100.

Perforating guns 30 of tool string 20 are coupled to direct connect sub 28 and are generally configured to perforate casing string 12 and provide for fluid communication between formation 6 and wellbore 4. Particularly, perforating guns 30 include a plurality of shaped charges that may be detonated by a signal conveyed by the wireline 22 from the surface to produce an explosive jet directed against casing string 12. Perforating guns 30 may be any suitable perforation gun known in the art while still complying with the principles disclosed herein. For example, in some embodiments, perforating guns 30 may comprise a hollow steel carrier (HSC) type perforating gun, a scalloped perforating gun, or a retrievable tubing gun (RTG) type perforating gun. In addition, gun 30 may comprise a wide variety of sizes such as, for example, 2¾", 3⅛", or 3⅜", wherein the above listed size designations correspond to an outer diameter of perforating guns 30.

Switch sub 32 of tool string 20 is coupled between the pair of perforating guns 30 and includes an electrical conductor and switch generally configured to allow for the passage of an electrical signal to the lowermost perforating gun 30 of tool string 20. Tool string 20 further includes plug-shoot firing head 34 coupled to a lower end of the lowermost perforating gun 30. Plug-shoot firing head 34 couples the perforating guns 30 of the tool string 20 to the setting tool 36 and bridge plug 100, and is generally configured to pass a signal from the wireline 22 to the setting tool 36 of tool string 20. Plug-shoot firing head 34 may also include mechanical and/or electrical components to fire the setting tool 36.

In this embodiment, tool string 20 further includes setting tool 36 and bridge plug 100, where setting tool 36 is coupled to a lower end of plug-shoot firing head 34 and is generally configured to set or install bridge plug 100 within casing string 12 to isolate desired segments of the wellbore 4. As will be discussed further herein, once bridge plug 100 has been set by setting tool 36, an outer surface of bridge plug 100 seals against an inner surface 13 of casing string 12 to restrict fluid communication through wellbore 4 across bridge plug 100. Additionally, unlike some downhole plugs such as frac plugs, once set, bridge plug 100 is configured to prevent fluid flow both uphole across (e.g., the annulus formed between the inner surface 13 of casing string 12 and an outer surface of bridge plug 100) bridge plug 100 (indicated schematically by arrow 15 in FIG. 1) towards the surface of wellbore 4, and downhole across bridge plug 100 (indicated schematically by arrow 17 in FIG. 1) towards a lower terminal end or toe (not shown) of wellbore 4. Setting tool 36 of tool string 20 may be any suitable setting tool known in the art while still complying with the principles disclosed herein. For example, in some embodiments, setting tool 36 may comprise a #10 or #20 Baker style setting tool. In addition, setting tool 36 may comprise a wide variety of sizes such as, for example, 1.68 in., 2.125 in., 2.75 in., 3.5 in., 3.625 in., or 4 in., wherein the above listed sizes correspond to the overall outer diameter of the tool. Although bridge plug 100 is shown in FIG. 1 as incorporated in tool string 20, bridge plug 100 may be used in other tool strings comprising components differing from the components comprising tool string 20. For example, in open hole applications, once set, bridge plug 100 may be configured to sealingly engage a wall of a wellbore (e.g., the wall 8 of wellbore 4) rather than the inner surface of a casing string (e.g., the inner surface 13 of casing string 12). Additionally, in other embodiments, bridge plug 100 may be employed in well systems other than a completion system. For instance, in some embodiments, bridge plug 100 may be used to permanently or temporarily abandon a completed wellbore.

Figure 2:
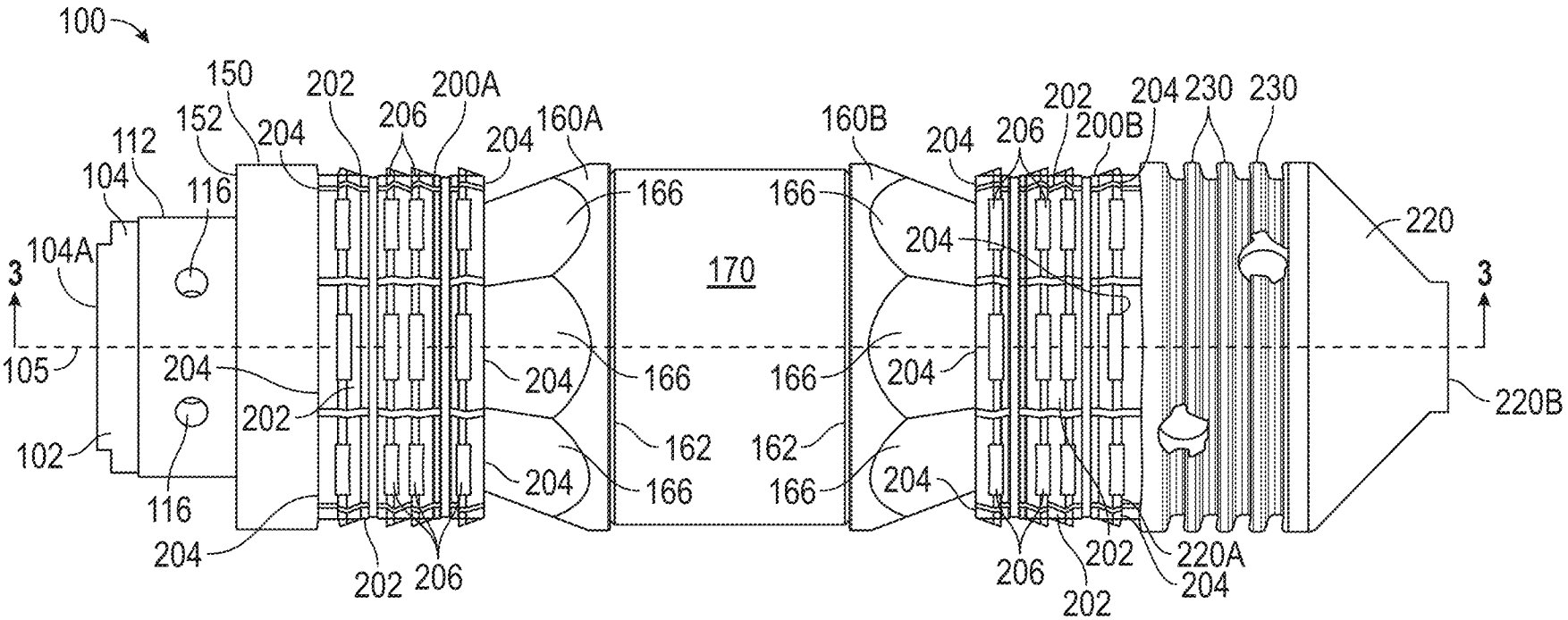
FIG. 2 is a side view of the downhole plug of FIG. 1 that includes an embodiment of a mandrel assembly in accordance with principles disclosed herein.
Figure 3:
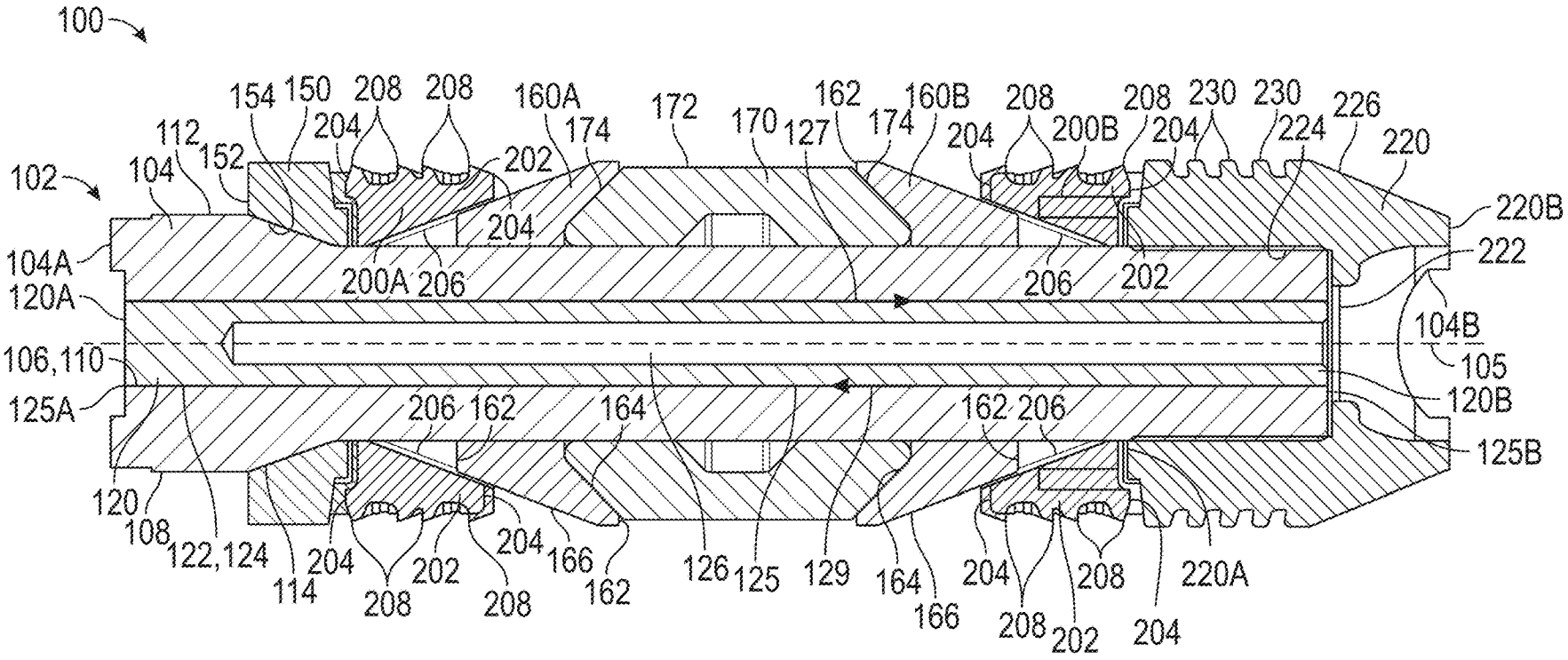
FIG. 3 is a cross-sectional view along line 3-3 of FIG. 2 of the downhole plug of FIG. 1.
Figure 4:
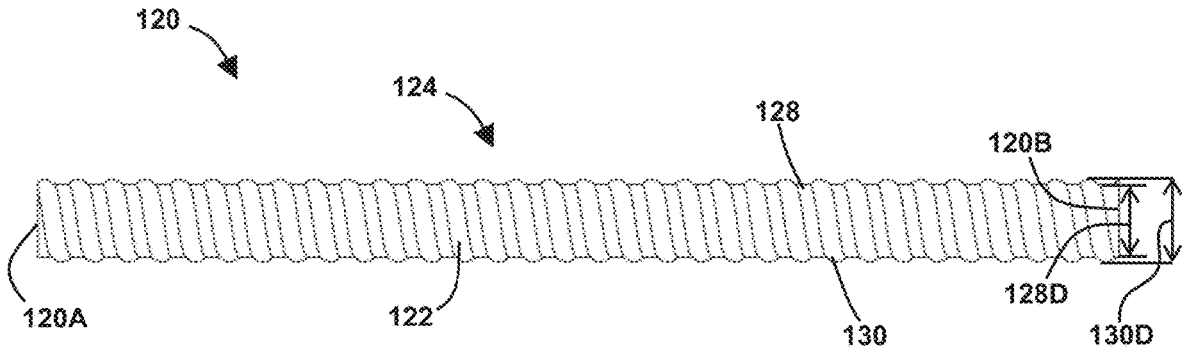
FIG. 4 is a side view of an embodiment of an inner rod of the mandrel assembly of FIG. 2 in accordance with principles disclosed herein.
Figure 5:
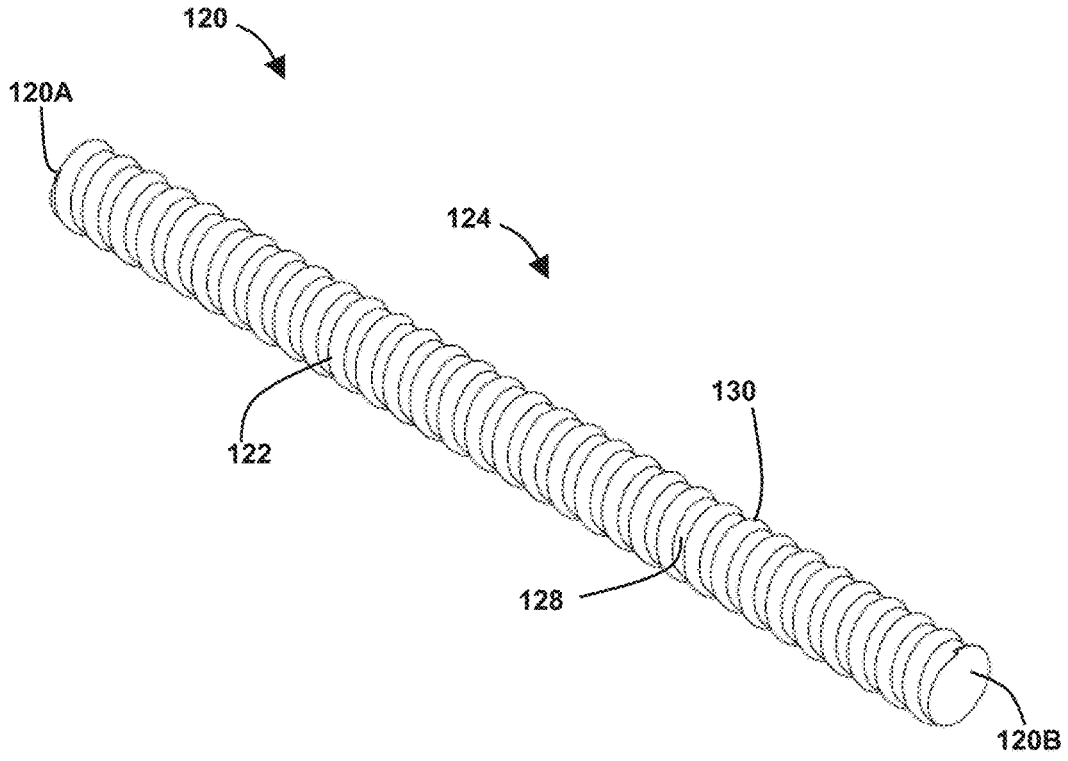
FIG. 5 is a perspective view of the inner rod of FIG. 4.
Figure 6:
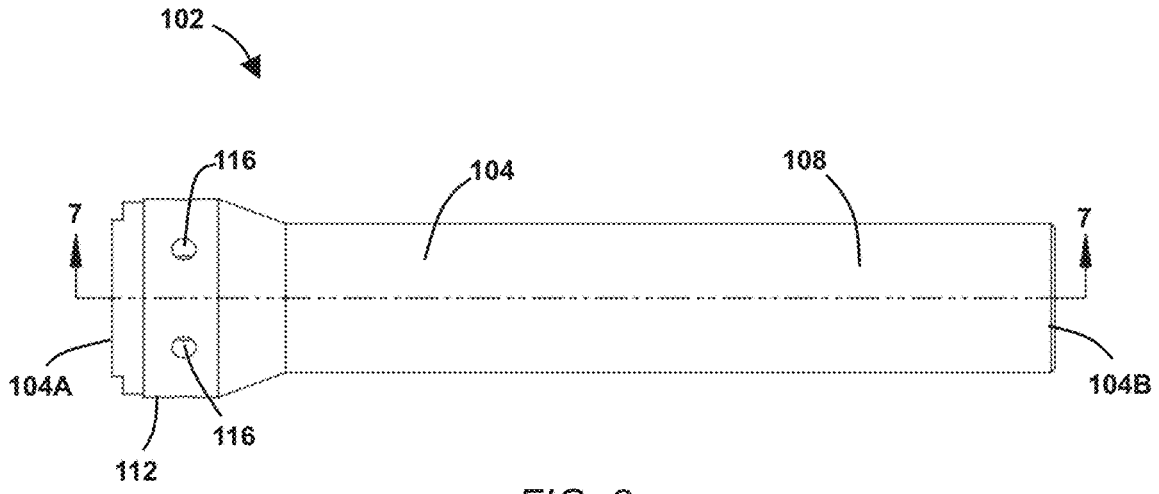
FIG. 6 is a side view of the mandrel assembly of FIG. 2.

Referring to FIGS. 1-3, an embodiment of the bridge plug 100 of the tool string 20 of FIG. 1 is shown in FIGS. 2, 3. In the embodiment of FIGS. 2, 3, bridge plug 100 has a central or longitudinal axis 105 and generally includes a mandrel assembly 102, an engagement disk 150, a pair of clamping members 160A, 160B, an elastomeric member or packer 170, a pair of slip assemblies 200A, 200B, and a nose cone 220.

Mandrel assembly 102 of bridge plug 100 is generally configured to interface with a setting tool (e.g., setting tool 36 shown in FIG. 1) to assist in "setting" or actuating bridge plug 100 from a first or run-in position shown in FIGS. 2, 3 to a second or set position. In this embodiment, mandrel assembly 102 of bridge plug 100 generally includes a first or outer cylindrical member or rod 104 and a second or inner cylindrical member or rod 120 positionable within outer rod 104. As shown particularly in FIG. 3, the outer rod 104 of mandrel assembly 102 has a first end 104A, a second end 104B opposite first end 104A, a central bore or passage defined by a generally cylindrical inner surface 106 extending between ends 104A, 104B, and a generally cylindrical outer surface 108 extending between ends 104A, 104B. In this embodiment, a first or inner surface pattern or feature 110 is positioned or formed on the inner surface 106 of outer rod 104, as will be described further herein.

In this embodiment, the outer surface 108 of outer rod 104 includes an expanded diameter portion 112 extending from first end 104A proximal upper end 104A which forms an annular shoulder 114. The expanded diameter portion 112 of outer surface 108 may include a plurality of circumferentially spaced apertures 116 (shown in FIG. 2) configured to receive a plurality of connecting members for coupling mandrel assembly 102 with setting tool 36; however, in other embodiments, outer rod 104 may not include either expanded diameter portion 112 and/or apertures 116. The outer surface 108 of outer rod 104 also includes a connector 118 at second end 104B for coupling mandrel assembly 102 with nose cone 220. In this embodiment, outer rod 104 of mandrel assembly 102 comprises a non-metallic, glass filament material; however, in other embodiments, outer rod 104 may comprise various materials. Although not included in this embodiment, in other embodiments, the outer surface 108 of outer rod 104 may include a plurality of ratchet teeth for engaging a body lock ring of downhole plug 100 configured for preventing the release of locking bridge plug 100 once plug 100 has been set by setting tool 36.

The inner rod 120 of mandrel assembly 102 has a first end 120A, a second end 120B opposite first end 120A, and a generally cylindrical outer surface 122 extending between ends 120A, 120B. In this embodiment, a second or outer surface pattern or feature 124 is positioned or formed on the outer surface 122 of inner rod 104, as will be described further herein. The outer surface pattern 124 of inner rod 120 is configured to matingly or interlockingly engage the inner surface pattern 110 of outer rod 104 to thereby resist or prevent relative axial movement between outer rod 104 and inner rod 120 following the assembly of mandrel assembly 102. Particularly, the interlocking engagement between the inner surface pattern 110 of outer rod 104 and the outer surface pattern 124 of inner rod 120 is configured to prevent dislodgement of inner rod 120 from outer rod 104 as mandrel assembly 102 is exposed to elevated pressures in wellbore 4 during the completion of wellbore 4 via completion system 10. While in this embodiment, outer rod 104 comprises inner surface pattern 110 and inner rod 120 comprises surface pattern 124, in some embodiments, outer rod 104 may not comprise an inner surface pattern and inner rod 120 may not comprise an outer surface pattern, and instead adhesion resulting from a filament winding process used to form outer rod 104 may serve to lock inner rod 120 with outer rod 104.

Additionally, the inner surface 106 of outer rod 104 sealingly engages the outer surface 122 of inner rod 120 following the assembly of mandrel assembly 102 to prevent fluid communication across a generally cylindrical interface 125 formed between outer rod 104 and inner rod 120. Particularly, sealing engagement between the inner surface 106 of outer rod 104 and the outer surface 122 of inner rod 120 restricts fluid flow across interface 125 in both a first axial (e.g., parallel with central axis 105) direction (indicated schematically by arrow 127 in FIG. 3) from first a first end 125A of interface 125 to a second end 125B of interface 125, and a second axial direction (indicated schematically by arrow 129 in FIG. 3) from second end 125B to first end 125A that is opposite of the first direction. Thus, sealing engagement between the inner surface 106 of outer rod 104 and the outer surface 122 of inner rod 120 restricts fluid flow in both axial directions across interface 125. Additionally, in this configuration, the outer rod 104 is locked to the inner rod 120 such that relative axial movement between inner rod 120 and outer rod 104 in either direction 127 or direction 129 is restricted.

In this embodiment, the inner rod 120 of mandrel assembly 102 additionally includes a central bore or passage 126 extending from second end 120B. Particularly, passage 126 of inner rod 120 extends towards, but not entirely to, the first end 120A of inner rod 120. As will be described further herein, in some applications, at some point following the setting of bridge plug 100 within wellbore 4, it may be desirable to permit fluid flow across bridge plug 100 in at least one axial direction. In order to establish fluid flow across the set bridge plug 100, a portion of the inner rod 120 of mandrel assembly 102 may be drilled or milled out by a downhole tool such that the drilled or milled passage formed by the downhole tool intercepts the central passage 126 of inner rod 120, thereby permitting fluid flow across bridge plug 100 via central passage 126. During this drilling or milling operation, central passage 126 may assist with equalizing fluid pressure across bridge plug 100. Although in this embodiment, inner rod 120 of mandrel assembly 102 includes central passage 126, in other embodiments, inner rod 120 may not include a central or inner passage. Inner rod 120 may comprise a material having relatively high tensile and shear strengths. In this embodiment, inner rod 120 comprises a non-metallic, composite material; however, in other embodiments, inner rod 120 may comprise fiberglass, magnesium, and other high tensile and shear strengths materials. Thus, in some embodiments, inner rod 120 may comprise a first material while outer rod 104 may comprise a second material that is different from the first material.

Engagement disk 150 of bridge plug 100 is disposed about mandrel assembly 102 and has a first end and a second end opposite the first end. In this embodiment, the first end of engagement disk 150 comprises an annular engagement surface 152 configured to engage a corresponding annular engagement surface of setting tool 36 to assist in actuating bridge plug 100 from the run-in position to the set position, as will be discussed further herein. Additionally, engagement disk 150 includes a generally cylindrical inner surface which defines an annular shoulder 154. In the run-in position of bridge plug 100, annular shoulder of engagement disk 150 is disposed directly adjacent or contacts shoulder 114 the outer rod 104 of mandrel assembly 102.

Each clamping member 160A, 160B of bridge plug 100 is generally annular and is disposed about the outer rod 104 of mandrel assembly 102. First clamping member 160A is axially positioned between first slip assembly 200A and packer 170 while second clamping member 160B is axially positioned between packer 170 and second slip assembly 200B. In this embodiment, each clamping member 160A, 160B has a generally cylindrical inner surface extending between opposing ends 162 thereof that includes an inner frustoconical surface 164. Additionally, each clamping member 160A, 160B includes a generally cylindrical outer surface extending between ends 162 that includes a plurality of circumferentially spaced planar (e.g., flat) surfaces 166. Each planar surface 166 extends at an angle relative to the central axis 105 of bridge plug 100. In some embodiments, friction resulting from contact between the elastomeric material comprising packer 170 and frustoconical surfaces 164 and 164 of clamping members 160A, 160B assists in preventing relative rotation between packer 170 and clamping members 160A, 160B.

Packer 170 of bridge plug 100 is generally annular and disposed about mandrel assembly 102 between clamping members 160A, 160B. Packer 170 comprises an elastomeric material and is configured to sealingly engage the inner surface 13 of casing string 12 when bridge plug 100 is set. In this embodiment, packer 170 comprises a generally cylindrical outer surface 172 extending between first and second ends of packer 170. Outer surface 172 of packer 170 includes a pair of frustoconical surfaces 174 extending from each end of packer 170, as will be discussed further herein.

Slip assemblies 200A, 200B of bridge plug 100 are generally configured to engage or "bite into" the inner surface 13 of casing string 12 when bridge plug 100 is actuated into the set position to couple or affix bridge plug 100 to casing string 12, thereby restricting relative axial movement between bridge plug 100 and casing string 12. In this embodiment, each slip assembly 200A, 200B comprises a plurality of circumferentially spaced arcuate slip segments 202 disposed about the outer rod 104 of mandrel assembly 102.

In some embodiments, one or more annular retainers or inserts may be disposed about the slip segments 202 of each slip assembly 200A, 200B In this embodiment, each slip segment 202 includes an inner surface extending between opposing ends 204 of slip segment 202 that includes a planar (e.g., flat) surface 206. The planar surface 206 of each slip segment 202 extends at an angle relative to central axis 105 of downhole plug 105 and is configured to matingly engage one of the planar surfaces 166 of one of the clamping members 160A, 160B.

The planar (e.g., flat) interface formed between each corresponding planar surface 166 of clamping members 160A, 160B and each planar surface 206 of slip segments 202 restricts relative rotation between clamping members 160A, 160B and the slip segments 202 of slip assemblies 200A, 200B. Additionally, as will be described further herein, relative axial movement between clamping members 160A, 160B and slip assemblies 200A, 200B is configured to force the slip segments 202 of slip assemblies 200A, 200B radially outwards via the angled or cammed sliding contact between planar surfaces 166 of clamping members 160A, 160B and the planar surfaces 206 of the slip segments 202 of slip assemblies 200A, 200B. In this embodiment, each slip segment 202 of slip assemblies 200A, 200B includes a generally arcuate outer surface extending between opposing ends 204 that includes a plurality of arcuate engagement members 208.

Engagement members 208 are configured to engage or bite into the inner surface 13 of casing string 12 when bridge plug 100 is actuated into the set position to thereby affix bridge plug 100 to casing string 12 at a desired or predetermined location. Thus, engagement members 208 comprise a suitable material for engaging with inner surface 13 of casing string 12 during operations. For example, engagement members 208 may comprise 8620 Chrome-Nickel-Molybdenum alloy, carbon steel, tungsten carbide, cast iron, and/or tool steel. In some embodiments, engagement members 208 may comprise a composite material. However, in other embodiments, slip segments 202 may not include separate engagement members 208. For example, instead of arcuate engagement members 208, in some embodiments, each slip segment 202 may comprise one or more cylindrical, ceramic engagement members or inserts configured to physically contact and couple to the inner surface of casing string 12. Additionally, while in this embodiment bridge plug 100 includes a pair of slip assemblies 200A, 200B, in other embodiments, bridge plug 100 may include a single slip assembly or more than two slip assemblies.

Nose cone 220 of bridge plug 100 is generally annular and is disposed about the second end 104B of the outer rod 104 of mandrel assembly 102. Nose cone 220 has a first end 220A, a second end 220B, a central bore or passage 222 defined by a generally cylindrical inner surface 224 extending between ends 220A, 220B, and a generally cylindrical outer surface 226 extending between ends 220A, 220B. In this embodiment, the inner surface 224 of nose cone 200 includes a connector 228 that releasably or threadably couples with the connector 118 of the outer rod 104 of mandrel assembly 102 to restrict relative axial movement between mandrel assembly 102 and nose cone 220. In this embodiment, the outer surface 226 of nose cone 220 includes a plurality of axially spaced annular fins 230. Fins 232 increase the surface area of outer surface 226 to facilitate the creation of turbulent fluid flow around fins 230 when bridge plug 100 is pumped through wellbore 4 along with the other components of tool string 20 to thereby increase the pressure differential in wellbore 4 between the uphole and downhole ends of bridge plug 100. However, in other embodiments, nose cone 220 of bridge plug 100 may not include fins 230.

Referring to FIGS. 2-7, FIGS. 4-7 illustrate an embodiment for forming or assembling the mandrel assembly 102 shown in FIGS. 2, 3. In the embodiment of FIGS. 2-7, inner rod 120 of mandrel assembly 102 is first formed through a pultrusion process until a desired length and outer diameter of inner rod 120 is achieved. Thus, in this embodiment, inner rod 120 comprises a pultruded rod. Following the formation of inner rod 120 via the pultrusion process, the outer surface 122 of inner rod 120 is machined to form outer surface pattern 124. In this embodiment, outer surface pattern 124 comprises a helical pattern 124 extending the length of inner rod 120 and comprising at least one helical recess or groove 128 and at least one helical protrusion or ridge 130. A maximum outer diameter 130D (shown in FIG. 4) of the helical ridge 130 of outer surface pattern 124 is greater than a maximum outer diameter 128D (shown in FIG. 4) of the helical groove 128. In other embodiments, the configuration of outer surface pattern 124 may vary. For instance, in other embodiments outer surface pattern 124 may comprise one or more protrusions of various shapes formed on the outer surface 122 of inner rod 120. In some embodiments, outer surface pattern 124 comprises a protrusion which is at least partially received within the inner surface pattern 110 of outer rod 104.

Figure 7:
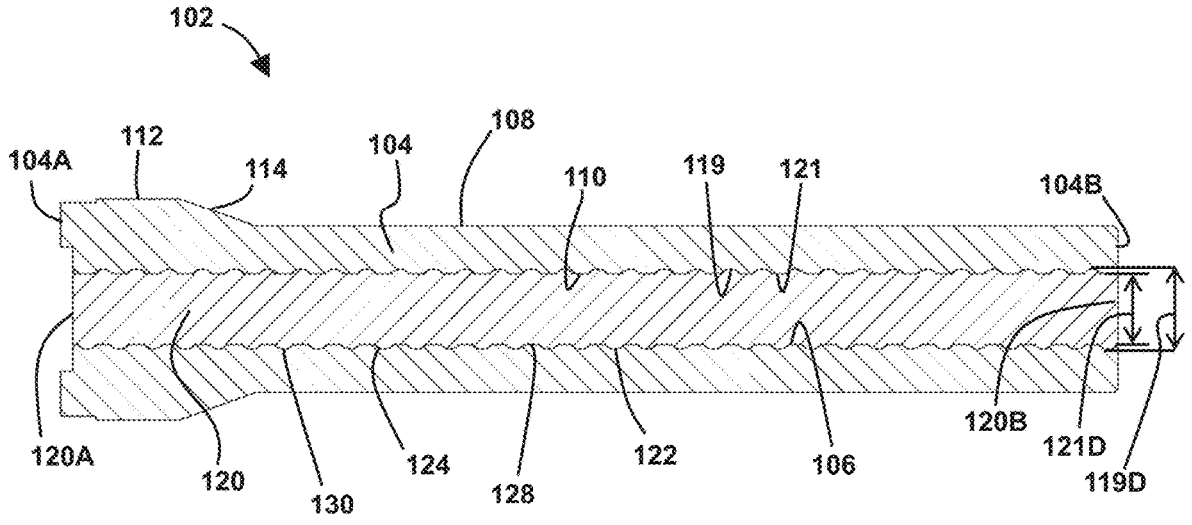
FIG. 7 is a cross-sectional view along lines 7-7 of FIG. 6 of the mandrel assembly of FIG. 2.

For example, inner surface pattern 110 may comprise at least one helical recess or groove 119 (shown in FIG. 7) and at least one corresponding helical protrusion or ridge 121 (shown in FIG. 7). The helical ridge 121 of inner surface pattern 110 may have a maximum inner diameter 121D that is less than a maximum inner diameter 119D of helical groove 119 of inner surface pattern 110. Additionally, the maximum inner diameter 121D of the helical ridge 121 of inner surface pattern 110 may be less than the maximum outer diameter 130D of the helical ridge 130 of outer surface pattern 124.

In this embodiment, once outer surface pattern 124 is formed on the outer surface 122 of inner rod 120, glass filaments are uniformly wound about the outer surface 122 of inner rod 120 to thereby form outer rod 104. In other words, outer rod 104 of mandrel assembly 102 is formed in this embodiment via a filament winding process until a desired outer diameter of outer rod 104 is achieved. The inner surface pattern 110 is formed on the inner surface 106 of outer rod 104 as outer rod 104 is formed via the filament winding process, thereby interlocking the outer surface pattern 124 of inner rod 120 into the inner surface pattern 110 formed on the inner surface 106 of outer rod 104. Particularly, the helical ridge 130 of the outer surface pattern 124 may be interlockingly received in the helical groove 119 of the inner surface pattern 110.

Once the desired outer diameter of outer rod 104 is achieved via the filament winding process, the outer surface 108 of outer rod 104 is machined to form annular shoulder 114 and circumferentially spaced apertures 116. In this embodiment, once the outer surface 108 of outer rod 104 is machined to form shoulder 114 and apertures 116, the formation of mandrel assembly 102 is completed by forming or drilling the central passage 126 of inner rod 120. As described above, in other embodiments, inner rod 120 of mandrel assembly 102 may not include central passage 126.

As described above, bridge plug 100 is conveyed downhole though wellbore 4 along with the other components of tool string 20. As tool string 20 is conveyed through wellbore 4, the position of tool string 20 in wellbore 4 is monitored at the surface via signals generated from CCL 26 and transmitted to the surface using wireline 22. Once tool string 20 is disposed in a desired location in wellbore 4, a firing or actuation signal may be transmitted from the surface to tool string 20 to actuate or fire setting tool 36 and thereby actuate bridge plug 100 from the run-in position shown in FIGS. 2, 3 to the set position.

Particularly, in this embodiment, setting tool 36 includes an inner member or mandrel (not shown) that moves axially relative to an outer member or housing of setting tool 36 upon the actuation of tool 36. The mandrel of setting tool 36 is coupled to the outer rod 104 of the mandrel assembly 102 of bridge plug 100 such that the movement of the mandrel of setting tool 36 pulls mandrel assembly 102 uphole (e.g., towards setting tool 36). Additionally, the outer member of setting tool 36 contacts engagement surface 152 of engagement disk 150 to prevent disk 150, clamping members 160A, 160B, packer 170, and slip assemblies 200A, 200B from travelling in concert with mandrel assembly 102, thereby providing relative axial movement between mandrel assembly 102 and disk 150, clamping members 160A, 160B, packer 170, and slip assemblies 200A, 200B.

As mandrel assembly 102 travels uphole towards setting tool 36, the planar surfaces 166 of clamping members 160A, 160B apply a radially outwards force against slip assemblies 200A, 200B, respectively, forcing slip segments 202 radially outward towards casing string 12 as planar surfaces 166 of clamping members 160A, 160B slide along the planar surfaces 204 of the slip segments 202 of slip assemblies 200A, 200B. Slip segments 202 of slip assemblies 200A, 200B continue to travel radially outwards until engagement members 206 contact and couple to the inner surface 13 of casing string 12, locking bridge plug 100 to casing string 12 at the desired location in wellbore 4.

Additionally, upwards travel of mandrel assembly 102 causes the inner frustoconical surfaces 164 of clamping members 160A, 160B to apply an axially compressive force against packer 170. The axially directed compressive force applied to packer 170 forces the outer surface 172 of packer 170 into sealing engagement with the inner surface 13 of casing string 12. With outer surface 172 of packer 170 sealing against the inner surface 13 of casing string 12, fluid flow across bridge plug 100 is restricted in both a first or downhole direction 13 (shown in FIG. 1) from an uphole end to a downhole end of bridge plug 100, and in a second or uphole direction 15 (shown in FIG. 1) from the downhole end to the uphole end of bridge plug 100. Particularly, sealing engagement between the outer surface 172 of packer 170 and the inner surface 13 of casing string 12, sealing engagement between an inner surface of packer 170 and the outer surface 108 of the outer rod 104 of mandrel assembly 102, and sealing engagement between the outer surface 22 of inner rod 120 and the inner surface 106 of outer rod 104 restrict fluid flow across bridge plug 100 in both the uphole and downhole directions 13, 15. In some embodiments, following the actuation of bridge plug 100 into the set position, casing string 12 is pressure tested to confirm the sealing integrity formed between bridge plug 100 and casing string 12. In certain embodiments, once casing string 12 has been successfully pressure tested, one or more firing signals may be transmitted from the surface to tool string 20 to fire one or more of the perforating guns 30 and thereby perforate casing string 12 at the desired location.

Following the perforation of casing string 12, setting tool 36 may be disconnected from bridge plug 100, allowing setting tool 36 and the other components of tool string 20 to be retrieved to the surface of wellbore 4, with bridge plug 100 remaining at the desired location in wellbore 4. In some embodiments, a lock ring of bridge plug 100 may retain bridge plug 100 in the set position once setting tool 36 is released from bridge plug 100. After tool string 20 has been retrieved from the wellbore 4, fluid is pumped into wellbore 4 from the surface and directed through the perforations previously formed in casing string 12 by one or more of the perforating guns 30, thereby hydraulically fracturing the formation 6 at the desired location in wellbore 4. In some embodiments, the hydraulic fracturing process described above is repeated a plurality of times at a plurality of desired locations in wellbore 4 moving towards the surface of wellbore 4 using frac plugs in lieu of bridge plug 100 in order to permit uphole fluid flow through the frac plugs set uphole from bridge plug 100. Thus, in some embodiments, bridge plug 100 may comprise the lowermost downhole plug installed within the casing string 12.

After the formation 6 has been hydraulically fractured at each desired location in wellbore 4, a tool may be deployed in wellbore 4 to drill out the bridge plug 100 disposed therein. Particularly, a downhole tool may be deployed through casing string 12 to drill into and through the inner rod 120 of the mandrel assembly 102 of bridge plug 100 from first end 120. The drill of the downhole tool may cut through inner rod 120 until the drill intercepts passage 126 of inner rod 120, thereby providing fluid communication between the uphole and downhole ends of bridge plug 100 via passage 126.

Figure 8:
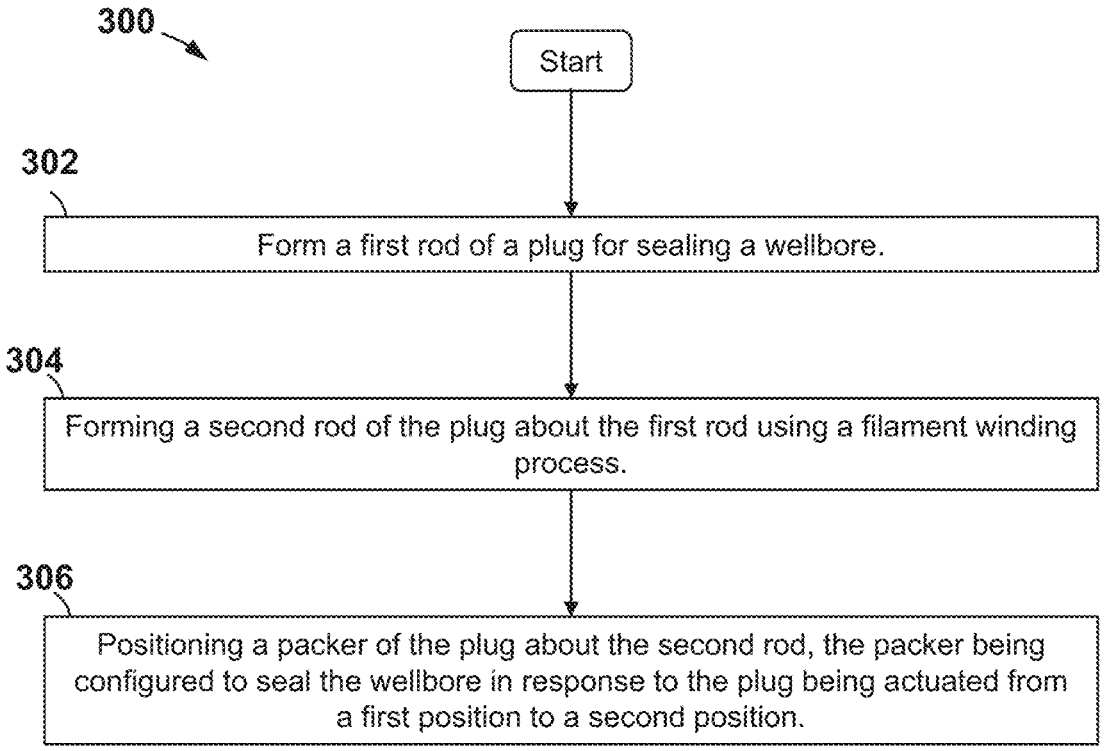
FIG. 8 is a flow chart of an embodiment of a method of assembling a plug for sealing a wellbore in accordance with principles disclosed herein.

Referring to FIG. 8, a flowchart of a method 300 of assembling a plug for sealing a wellbore is shown in FIG. 8. In some embodiments, method 300 may be practiced with the bridge plug 100 shown in FIGS. 2-7. Thus, in describing the features of method 300, continuing reference will be made to bridge plug 100 shown in FIGS. 2-7; however, it should be appreciated that embodiments of method 300 may be practiced with other devices.

Initially, method 300 includes forming a first rod at method block 302. In some embodiments, method block 302 may include forming the inner rod 120 of mandrel assembly 102 through a pultrusion process until a desired length and outer diameter of inner rod 120 is achieved. In some embodiments, method block 302 may also include machining a surface pattern (e.g., surface pattern 124 of inner rod 120) onto an outer surface of the inner rod. In some embodiments, the pattern may be a helical pattern including one or more helical grooves (e.g., helical groove 128) and one or more helical ridges (e.g., helical ridge 130).

Method 300 continues at method block 304 by forming a second rod about the first rod using a filament winding process. In some embodiments, method block 304 may include uniformly winding glass filaments about the outer surface of the formed inner rod (e.g., inner rod 120 of mandrel assembly 102) until a desired outer diameter of the outer rod (e.g., outer rod 104 of mandrel assembly 102) is achieved. Method block 304 may also include forming a surface pattern on an inner surface of the outer rod as the outer rod is wound about the outer surface of the inner rod. In some embodiments, the surface pattern may be a helical pattern including one or more helical grooves (e.g., helical groove 119) and one or more helical ridges (e.g., helical ridge 121).

Method 300 continues at block 306 by positioning a packer about the second rod, the packer being configured to seal the wellbore in response to the plug being actuated from a first position to a second position. In some embodiments, method block 306 may include positioning packer 170 about the outer surface 108 of the outer rod 104 of mandrel assembly 102. In some embodiments, method 300 may further include positioning engagement disk 150, clamping members 160A, 160B, and slip assemblies 200A, 200B about the outer surface 108 of outer rod 104.

Embodiments disclosed herein include a downhole plug (e.g., bridge plug 100) comprising a mandrel assembly (e.g., mandrel assembly 102) comprising an inner rod (e.g., inner rod 120) and a filament wound outer rod (e.g., outer rod 104) that is separate and distinct from the inner rod and which is formed about the inner rod. The downhole plug may also include a packer (e.g., packer 170) disposed about the mandrel assembly, the packer configured to seal the wellbore in response to the plug being actuated from a first position to a second position, wherein the mandrel assembly is configured to apply a compressive force to the packer as the plug is actuated from the first position to the second position.

By forming the mandrel assembly using a filament winding process the costs associated with manufacturing the mandrel assembly may be minimized (e.g., relative to compression molded mandrel assemblies, etc.). For instance, the number of parts required to form the mandrel assembly may be minimized by utilizing a filament winding process. Additionally, the simplified design offered by the filament wound mandrel assemblies described herein also minimize the number of points at which a failure of the mandrel assembly may occur, thereby increasing the reliability of the mandrel assembly. Further, the seal created by the filament wound mandrel assembly may enable a downhole plug incorporating the mandrel assembly to withstand relatively greater differential pressures across the plug (following setting of the plug) than other designs which may, for instance, rely on elastomeric seals (e.g., O-ring seals, etc.) for forming a seal barrier.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A bridge plug for sealing a wellbore, comprising:

a mandrel assembly comprising an inner rod that is solid across a central axis thereof to restrict fluid communication across the mandrel assembly in both a first axial direction and an opposed second axial direction, and an outer rod comprising a different material than the inner rod and that is distinct from the inner rod whereby the outer rod overlies the inner rod; and a packer disposed about the mandrel assembly, the packer configured to seal the wellbore in response to the bridge plug being actuated from a first position to a second position, wherein the mandrel assembly is configured to apply a compressive force to the packer as the bridge plug is actuated from the first position to the second position and to maintain the compressive force until removed by an external tool.

2. The bridge plug of claim 1, wherein the inner rod comprises a pultruded rod and the outer rod comprises a filament wound outer rod.

3. The bridge plug of claim 1, wherein the inner rod comprises a composite material and the outer rod comprises a glass filament material.

4. The bridge plug of claim 1, wherein:

the outer rod of the mandrel assembly comprises an inner surface and an inner surface feature positioned on the inner surface; and the inner rod of the mandrel assembly comprises an outer surface and an outer surface feature positioned on the outer surface that is in interlocking engagement with the inner surface feature of the outer rod.

5. The bridge plug of claim 4, wherein the outer surface feature of the inner rod comprises a protrusion received within the inner surface feature of the outer rod.

6. The bridge plug of claim 1, wherein an end of the outer rod is configured to couple to a setting tool for actuating the bridge plug from the first position to the second position.

7. The bridge plug of claim 1, further comprising a slip assembly configured to affix the plug to a string disposed in the wellbore in response to the bridge plug being actuated from the first position to the second position.

8. The bridge plug of claim 1, wherein:

the outer rod of the mandrel assembly comprises a first helical pattern formed on an inner surface of the outer rod and which comprises a first helical groove and a first helical ridge; and the inner rod of the mandrel assembly comprises a second helical pattern formed on an outer surface of the inner rod and which comprises a second helical groove and a second helical ridge, wherein the second helical ridge is interlockingly received in the first helical groove.

9. The bridge plug of claim 1, wherein the inner rod is solid across the entire outer diameter of the inner rod.

10. A plug for sealing a wellbore, comprising:

a mandrel assembly comprising an outer rod comprising an inner surface and an inner surface feature positioned on the inner surface, and an inner rod that is distinct from the outer rod and comprises a different material than the outer rod, wherein the inner rod comprises an outer surface and an outer surface feature positioned on the outer surface that is in interlocking engagement with the inner surface feature of the outer rod; and a packer disposed about the mandrel assembly, the packer configured to seal the wellbore in response to the plug being actuated from a first position to a second position, wherein the mandrel assembly is configured to apply a compressive force to the packer as the plug is actuated from the first position to the second position;

wherein the interlocking engagement between the inner rod and the outer rod overlaps the packer along a longitudinal axis of the plug such that the inner rod and the outer rod jointly resist axial loads applied to the uphole end of the outer rod.

11. The plug of claim 10, wherein the outer surface feature of the inner rod comprises a protrusion received within the inner surface feature of the outer rod.

12. The plug of claim 10, wherein the outer surface feature of the inner rod comprises a first helical pattern and the inner surface feature of the outer rod comprises a second helical pattern.

13. The plug of claim 12, wherein the first helical pattern comprises a helical ridge that is interlockingly received in a helical groove of the second helical pattern.

14. The plug of claim 10, wherein the outer surface feature of the inner rod is configured to increase a surface roughness of the outer surface of the inner rod.

15. The plug of claim 10, wherein the inner rod comprises a pultruded rod and the outer rod comprises a filament wound rod.

16. The plug of claim 10, wherein the inner rod comprises a central passage extending partially through the inner rod.

17. The plug of claim 10, further comprising a slip assembly configured to affix the plug to a string disposed in the wellbore in response to the plug being actuated from the first position to the second position.

18. The plug of claim 10, wherein sealing contact between the inner surface of the outer rod and the outer surface of the inner rod resulting from the interlocking engagement between the inner surface feature and the outer surface feature seals an annular interface formed between the outer rod and the inner rod.

19. A method for fracturing an earthen subterranean formation, the method comprising:

(a) deploying a tool string into a wellbore extending through the subterranean formation, the tool string comprising a perforating gun and a bridge plug including a mandrel assembly that comprises an inner rod that is solid across a central axis of the inner rod, and an outer rod that is distinct from the inner rod such that the outer rod overlies the inner rod, and further wherein the outer rod comprises a different material than the inner rod and the inner rod and the outer rod cooperate to restrict fluid communication across the mandrel assembly in both a first axial direction and an opposed second axial direction;

(b) actuating the bridge plug from a first position to a second position whereby a packer of the bridge plug disposed about the mandrel assembly seals the wellbore, wherein the mandrel assembly applies a compressive force to the packer as the bridge plug is actuated from the first position to the second position;

(c) actuating the perforating gun to form a plurality of perforations in a casing string lining the wellbore thereby establishing fluid communication between the wellbore and the subterranean formation;

(d) pumping a fracturing fluid through the wellbore and into the subterranean formation through the plurality of perforations formed in the casing string; and (e) drilling out the mandrel assembly of the bridge plug by an external tool to release the compressive force applied by the mandrel assembly to the packer of the bridge plug.

20. The method of claim 19, wherein (e) establishes fluid communication across the mandrel assembly in at least one of the first axial direction and the second axial direction.

21. The method of claim 19, wherein the inner rod is solid across the entire outer diameter of the inner rod.

* * * * *